US008519369B1

(12) United States Patent
Benjamin et al.

(10) Patent No.: US 8,519,369 B1
(45) Date of Patent: Aug. 27, 2013

(54) HANDHELD ILLUMINATION DEVICE

(75) Inventors: David Benjamin, Jupiter, FL (US); Timo Tervola, Palm Beach Gardens, FL (US); Sean Rosario, Coral Springs, FL (US); Patric Martin Benda, Stuart, FL (US)

(73) Assignee: Tactical Revolution, LLC, Jupiter, FL (US)

( * ) Notice: Subject to any disclaimer, the term of this patent is extended or adjusted under 35 U.S.C. 154(b) by 0 days.

(21) Appl. No.: 13/599,993

(22) Filed: Aug. 30, 2012

(51) Int. Cl.
*G21K 5/04* (2006.01)
*F41G 1/34* (2006.01)

(52) U.S. Cl.
USPC ..... 250/504 H; 250/504 R; 250/493.1; 362/109; 362/113; 362/114

(58) Field of Classification Search
USPC ..... 250/493.1, 494.1, 495.1, 503.1, 504 R, 250/504 H; 362/109, 113, 114
See application file for complete search history.

(56) References Cited

U.S. PATENT DOCUMENTS

| | | | | |
|---|---|---|---|---|
| 8,152,323 | B2 | 4/2012 | Bushee | |
| 2009/0196033 | A1* | 8/2009 | MacDonald | 362/234 |
| 2010/0141153 | A1* | 6/2010 | Recker et al. | 315/149 |
| 2011/0299274 | A1* | 12/2011 | Schwarz | 362/183 |

OTHER PUBLICATIONS

Brite Strike Tactical Balls YouTube video as seen at http://www.youtube.com/watch?v=6zYmbDi3-2g on Aug. 30, 2012, 0:44 minutes.

Tactical Balls product information, taken from http://www.brite-strike.com/tactical-balls.html on Aug. 30, 2012, 2 pages.

* cited by examiner

*Primary Examiner* — Nicole Ippolito
(74) *Attorney, Agent, or Firm* — Foley & Lardner LLP

(57) ABSTRACT

A handheld illumination device is disclosed. The handheld illumination device may include a housing configured to be held in a hand, an input device configured to be actuated by a user, a battery, an illumination source, and a processing circuit. In response to an actuation of the input device, the processing circuit is configured to start a timer without illuminating the illumination source and, upon expiration of the timer, to illuminate the illumination source.

14 Claims, 9 Drawing Sheets

HANDHELD ILLUMINATION DEVICE

BACKGROUND

The present disclosure relates generally to handheld devices that may be used as a supplement to night vision equipment. In particular, the present disclosure relates to a handheld device that may be projected in the vicinity of an adversary to illuminate the adversary for night vision equipment.

SUMMARY

In one implementation, a handheld illumination device is disclosed. The illumination device may include a housing configured to be held in a hand. The illumination device may further include an input device configured to be actuated by a user. The illumination device may also include a battery. The illumination device may include an illumination source. The illumination device may yet further include a processing circuit, in response to an actuation of the input device, configured to start a timer without illuminating the illumination source and, upon expiration of the timer, to illuminate the illumination source.

In another implementation, a handheld illumination device is disclosed. The illumination device may include a housing configured to be held in a hand. The illumination device may further include an input device configured to be actuated by a user. The illumination device may also include a battery. The illumination device may include an illumination source, wherein the illumination source is configured to transmit light substantially omnidirectionally.

In yet a further implementation, a handheld illumination device is disclosed. The illumination device may include a hermetically sealed housing that is configured to be held in a hand and configured to provide buoyancy. The illumination device may further include an input device configured to be actuated by a user. The illumination device may also include a battery. The illumination device may include an illumination source, wherein the illumination source is configured to transmit infrared light.

DETAILED DESCRIPTION

Figure 1:
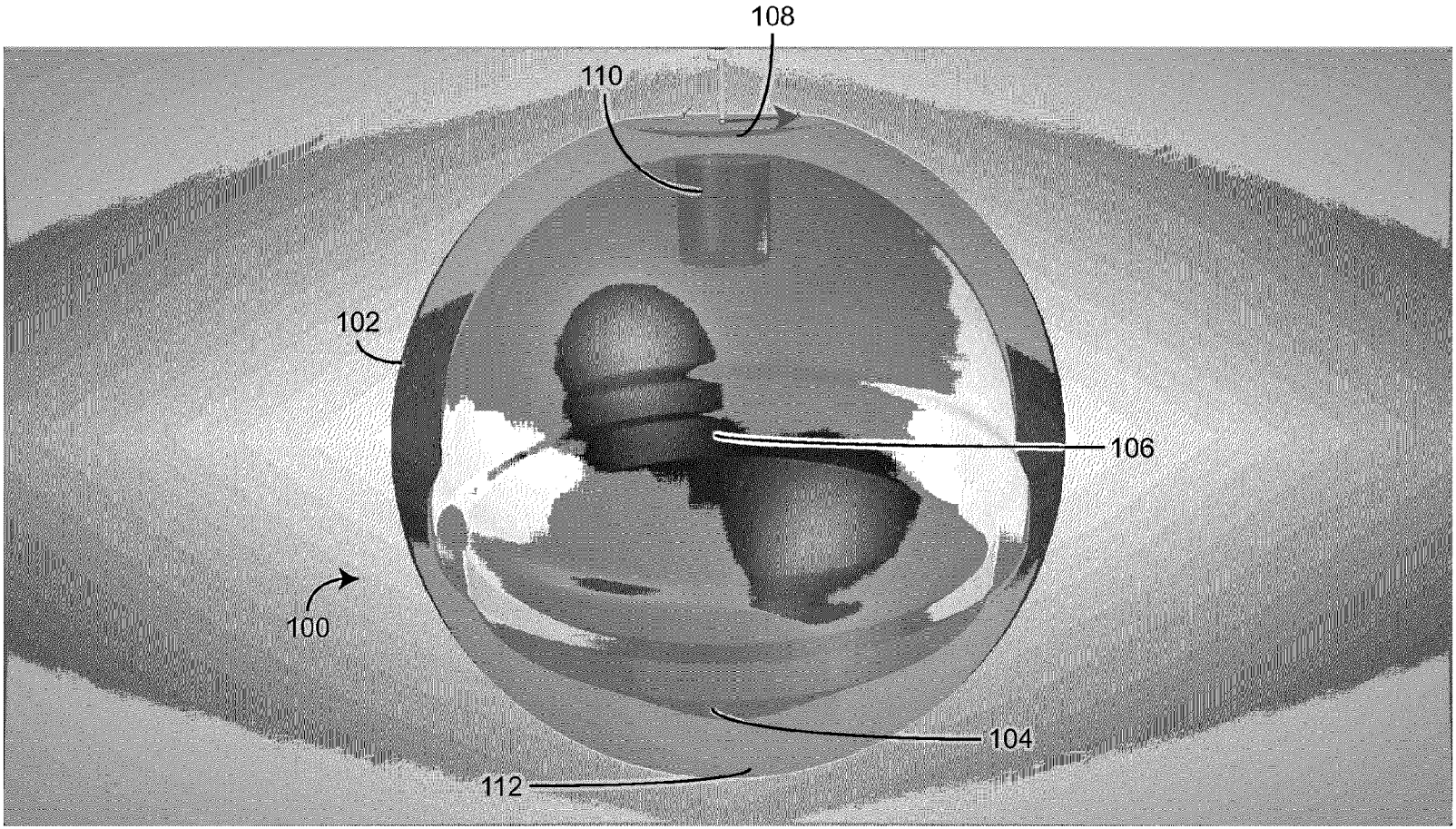
FIG. 1 is an illustration of the interior of the handheld illumination device along with internal shell of the device in accordance with a described implementation.

Numerous specific details may be set forth below to provide a thorough understanding of concepts underlying the described implementations. It may be apparent, however, to one skilled in the art that the described implementations may be practiced without some or all of these specific details.

The device may be used in training, tactical and other operations. In other implementations, the device may be used in games or other simulations.

The handheld illumination device may be used as a supplemental light for night vision equipment. For example, in a low-lit area, with little or no ambient light (natural or man-made), night vision equipment may comprise its own infrared light source. Infrared radiation or light is used to enable the user to better see objections with the night vision equipment.

Because infrared light originates from night vision equipment worn by a user, it is important to adapt the light in a manner as to not give away the user's position to the adversary. For example, if an adversary is also using night vision equipment, then it is easy for the adversary to identify the position of the user, therefore, making the user a target for the adversary. The device may use a specific frequency of infrared light in order to effectively supplement the night vision equipment.

The handheld illumination device may include timing electronics, such as an electronic time-delay fuse, that the user can activate manually by squeezing the device by hand in a specified location. The time delayed activation allows the user to activate the device and throw it to a specific location, where it will activate after a specified amount of time. As a result, there is no signature as to where the light source originated from and the user does not have to provide a direct light source from his/her position. The size of the device allows the user to quickly activate and project one or more of the devices to gain a tactical advantage.

The handheld illumination device may have a predetermined time during which the input device must be depressed before the device is activated or deactivated. This prevents accidental discharge of light during times when the user wants to remain undetected. Once the input device has been depressed for the specified time period, the user will receive low-light feedback within the visible light spectrum (e.g., via a red light-emitting diode or LED) confirming that the device time-delay fuse has been activated. The user may also receive low-light feedback in a different visible light color (e.g., via a green LED) confirming that the handheld illumination device has been deactivated.

The handheld illumination device may also aid in detection (directly or indirectly) of adversaries or other objects by using an infrared shadow that is cast by the light. The device may alternatively be used as a distraction device, a rescue aid, etc. For example, a number of the devices may be projected into a ring in the water around a user to aid in rescue/extraction. In another implementation, the device may be used as a strobe for red, green, yellow and other light.

Referring to FIG. 1, an illustration of the interior shell of the handheld illumination device is shown. Illumination device 100 includes housing 102, center of mass 104, physical center 106, faceted side 108 and input device 110.

Housing 102 may include a faceted side 108 adjacent to input device 110. The faceted side may allow the user to feel input device 110, such as the internal switch location (illustrated on the top side), regardless of environmental conditions in which gloves are required or other conditions that conceal the location of the switch. The faceted side may also include an extrusion peg that minimizes compression or activation stroke by the user to activate the illumination device. The bottom side also has a faceted surface (not shown), which may be larger than the top side facet in surface area. The bottom side facet may serve as a stable base for the device when desired and also enhances the probability that the device will land upright if thrown. The faceted sides may be formed by extrusion molding, casting, or other processes.

In some implementations, input device 110 may be configured to be actuated by a user squeezing housing 102, for example in an embodiment where housing 102 is flexible at least in a portion near input device 110. Alternatively, input device 110 may be configured to be actuated by a user using other methods, such as shaking, tapping, receiving an audible command, etc.

Illumination device 100 may be designed such that the center of mass 104 of illumination device 100 may be in the lower portion of housing offset from physical center 106 of device 100, so that the device may be more likely to come to rest on a predetermined portion of housing 102. For example, the faceted side 112 (also shown in greater detail in FIG. 6 (604) may be the predetermined portion of housing 102. One or more illumination sources (not shown) may be disposed on or near faceted and/or non-faceted portions of housing 102.

Housing 102 may comprise a transparent or translucent material so that the device may emit light radiation when thrown or placed in a location, regardless of its actual orientation. Regardless of whether the device lands on its side, right-side-up, or upside-down, the illumination devices within the housing may be oriented or arranged in a number of different locations so as to provide substantially omnidirectional light.

Center of mass 104 of the internal shell is such that the device is unbalanced, favoring the bottom side; this increases the odds of the device landing right-side-up when thrown. Center of mass 104 of the internal shell also allows the device to float upright.

Figure 2A:
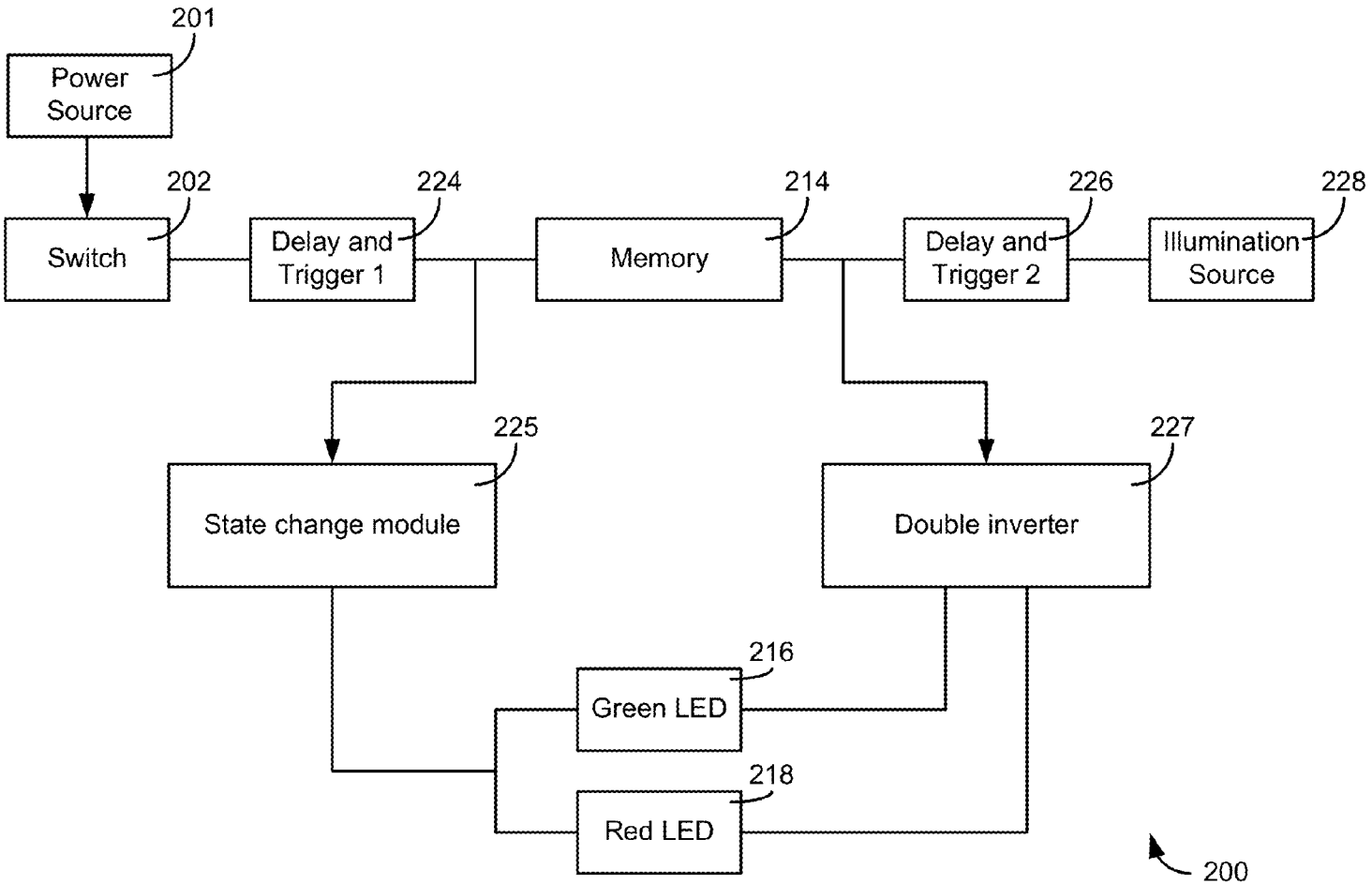
FIG. 2A is a block diagram of a handheld illumination device, in accordance with a described implementation.

Referring to FIG. 2A, a processing circuit of the handheld illumination device is illustrated. The illumination device may be a self-contained unit, comprising light-emitting diodes in an interior and an outer shell or housing. Processing circuit 200 is disposed in the interior of the device and may include a circuit board and a power source. Coupled to the circuit board may be switch 202 (on/off), illumination sources 216, 218, 228 of various wavelengths of electromagnetic radiation, including visible light (e.g., white, red, green, etc.), infrared, and/or ultraviolet. The processing circuit may also comprise timing electronics 214, 224, 226, for time-delayed activation and deactivation, a power source holder (not shown), and power source 201. The components may be self-contained in the housing of the handheld illumination device, which may be hermetically sealed to ensure water tight separation of the components within the housing from the exterior of the device.

Switch 202 may be disposed beneath the housing or partially exposed (not shown) to the user. Switch 202 initiates the powering of the illumination sources 216, 218 and/or 228. Power source 201 may include a battery that powers the processing circuit, and, ultimately the illumination device. Control and timing electronics 214, 224, 226 may be connected to switch 202 and/or power source 201.

Processing circuit 200 may include memory 214, delay and trigger 1 ("depression timer") 224, state change module 225, delay and trigger 2 ("delayed activation timer") 226, and double inverter 227. Processing circuit 200, in response to actuation of the input device 202, may be configured to start a timer (via depression timer 224, delayed activation timer 226 and memory 214) without illuminating an illumination source. Memory 214 may store the current state of processing circuit 200. State change module 225 may drive visible light LEDs 216, 218, which display which state the device is changing to. Double inverter 227 may determine which visible light LED 216, 218 activates for a current state.

Figure 2B:
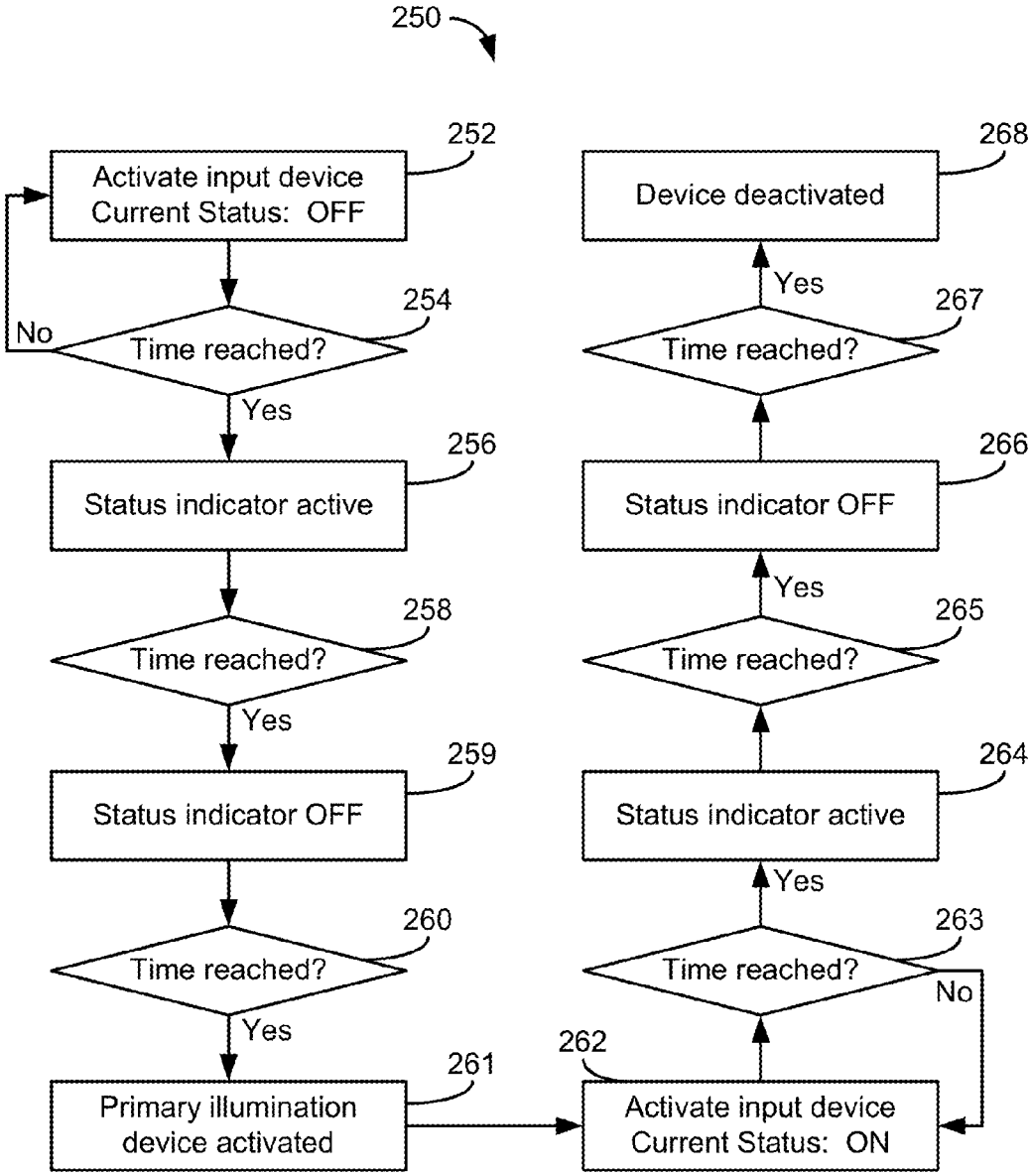
FIG. 2B is a flow diagram of the illumination of the handheld device, in accordance with a described implementation.

Processing circuit 200 removes or blocks power to the illumination source 228 (e.g., the infrared light source or sources) during a predetermined time period of the timer circuit. Upon expiration of the time period, the illumination source will be illuminated by applying power to illumination source 228 via delayed activation timer 226, as shown in FIG. 2B. Each delay and trigger/timer may be manually programmed for a specific amount of time.

FIG. 2B is a flow diagram 250 of the illumination of the handheld device, in accordance with a described implementation. At 252, the input device may be actuated, e.g., a user may press the button for a period of time 254 associated with depression timer 224, such as five seconds. At 256, illumination source 218 may then be activated, e.g., a status indicator is set to active, which may include a red visible light that provides feedback to the user that the handheld device has been activated and that the user has a specified amount of time (e.g., x seconds) to project the device before the device illuminates or to deactivate the device.

At 258, a period of time for the activation of illumination source 218 begins (red visible light), such as 3 seconds, meaning that illumination source 218 remains active for the period of time. If the period of time expires without user interaction, then the status indicator is set to off (at 259), meaning illumination source 218 is deactivated.

At 260, another specified amount of time commences, such as 10-15 seconds, before the device begins activation toward the infrared illumination at 261. After the expiration of the specified amount of time is reached at 260, then illumination source 228, which may include infrared light (invisible to the user), may be activated at 261.

Delayed activation timer 224 may also be set after the device has been activated. For example, at 262, after the infrared light of illumination source 228 has been provided to the user (261), the delayed activation timer 224 may provide another delay for a specified amount of time (e.g., 5 seconds) that allows the user to press the button again (263), which activates illumination source 216 (e.g., green visible light). If the user does not depress the button for a specified amount of time, then the illumination source 228 is activated and may be projected by the user.

At 264, the user has depressed the button for the specified amount of time (263) and timer 224 activates illumination source 216, which may include a green visible light that provides feedback to the user that the handheld device has been deactivated, meaning the device will not illuminate. At 265, a specified amount of time (e.g., 3 seconds) may be determined, which may then deactivate illumination source 216, turning the status indicator to off (266). At 267, another specified amount of time commences, such as 10-15 seconds, and once the specified amount of time expires, the device is deactivated (268).

Timing electronics 214 and depression timer 224, delayed activation timer 226 may be used to determine the timing, after switch 202 is activated, for illumination sources 216, 218, 228. Illumination sources may include LEDs, but may also include other types of illumination sources such as organic LEDs. The feedback provided to the user may include a variety of light sources, sound sources (e.g., vibration), and any other mechanism suitable to the user and to the user's environment.

Figure 3A:
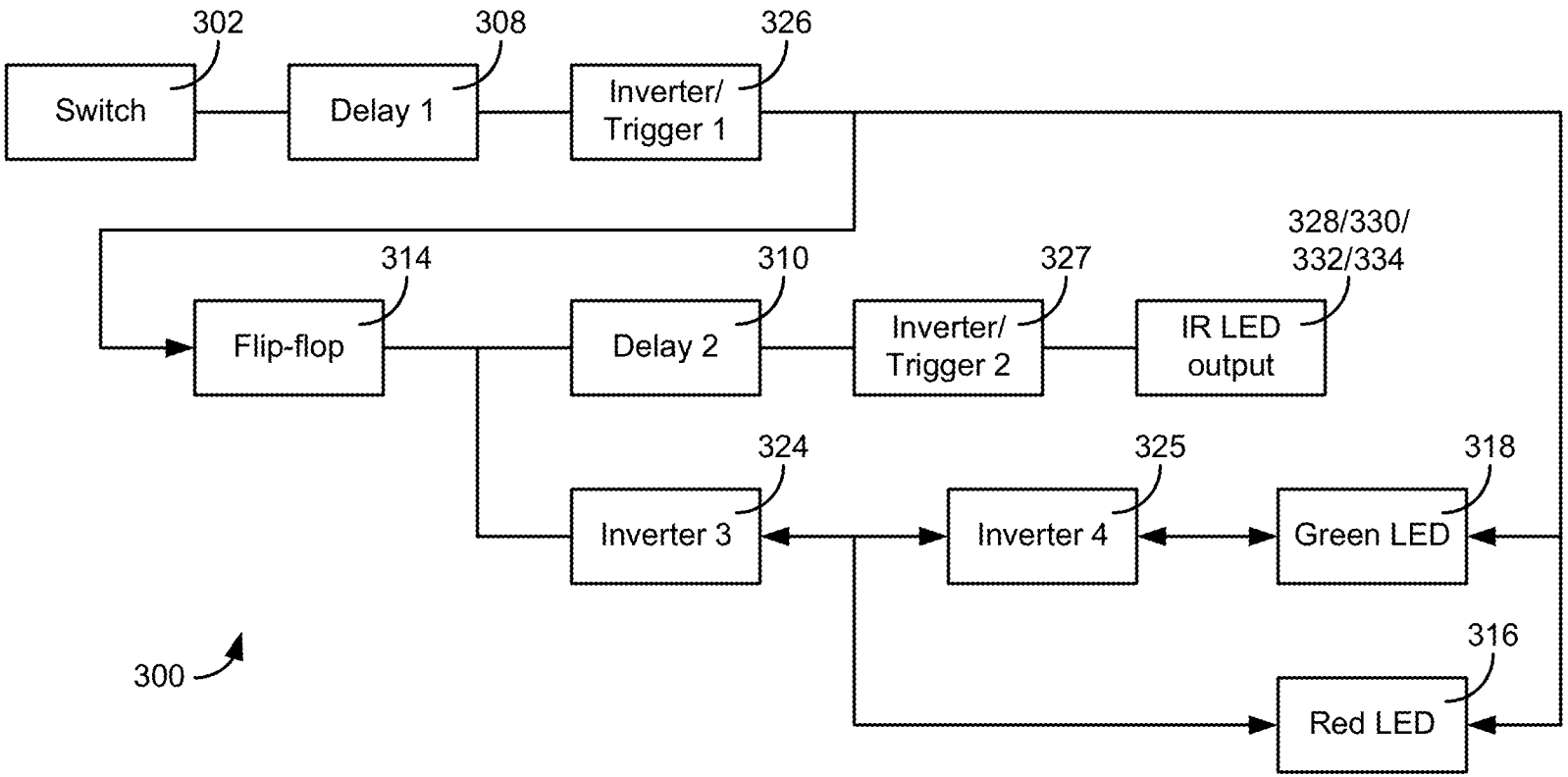
FIG. 3A is an overview of a circuit diagram of the handheld illumination device shown in FIG. 2, in accordance with a described implementation.
Figure 3B:
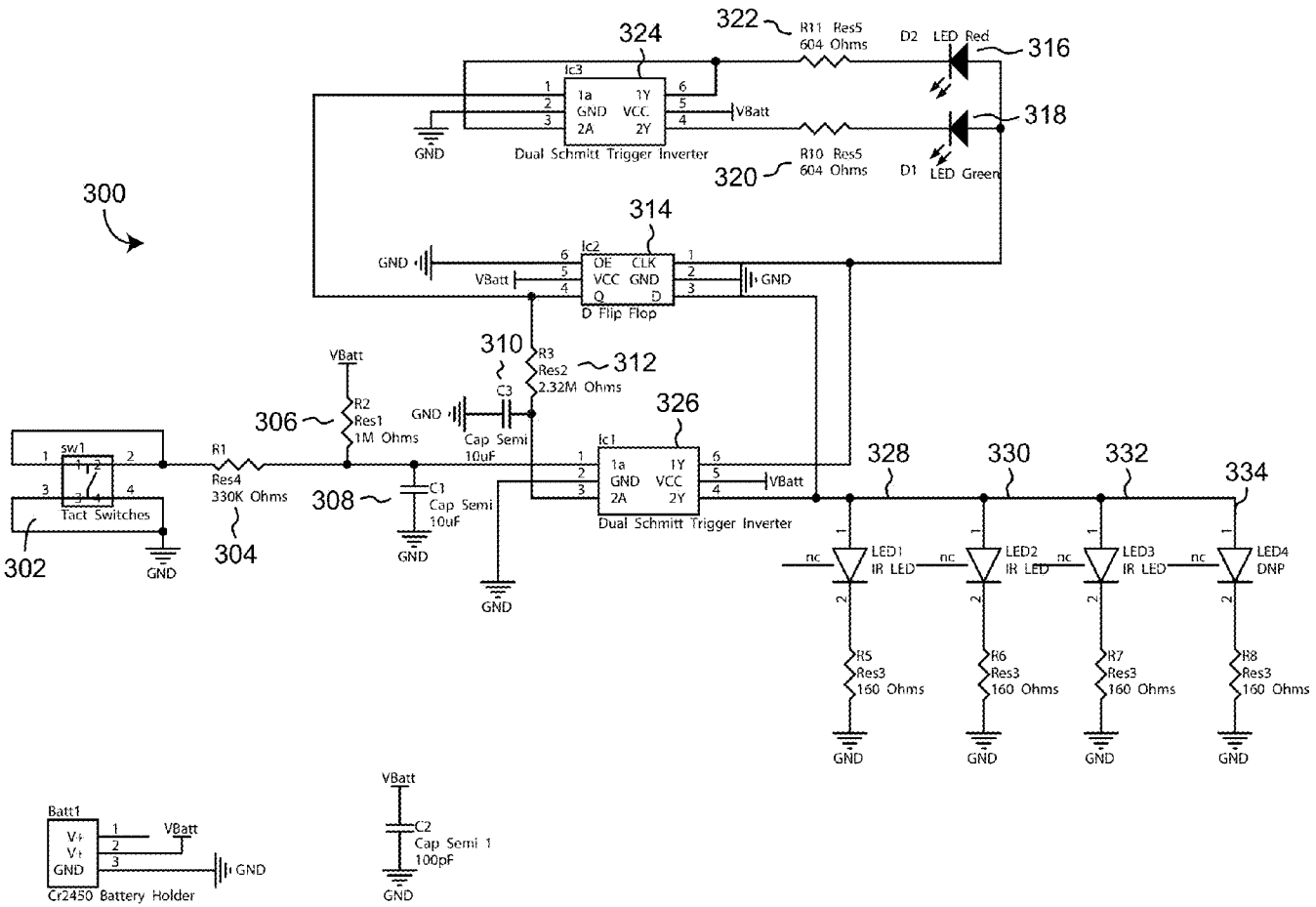
FIG. 3B is a detailed circuit diagram of the handheld illumination device shown in FIG. 2, in accordance with a described implementation.

Referring to FIG. 3A, an overview of the circuit diagram detailed in FIG. 3B is shown. The handheld illumination device may include processing circuit 300. Processing circuit 300 may include a circuit board. One or more of the input device, illumination device, switch and battery may be coupled to the circuit board, which may be a single circuit board in one embodiment.

Input device 302 (e.g., switch) initiates operation of the illumination device in response to a user press. Circuit 300 may include resistive components 304, 306 to power input device 302. One or more power sources, such as a battery (VBatt), may be coupled to an electrical contact on switch 302 through resistive components 306 and 304. Switch 302 is an input to a first delay 308. The first delay 308, which may include components 304, 306 and 308, may provide a specified amount of time for the user to interact with the device. When switch 302 is depressed, capacitor 308 is drained through resistor 304 and switch 302. When the capacitor 308 reaches the proper voltage level, Inverter/Trigger 1 326 changes state. When switch 302 is released, capacitor 308 is charged via resistor 306, and Inverter/Trigger 1 326 changes state again. These state changes generate a pulse. This pulse is used to alter the state of flip flop 314. The pulse may also be used to drive visible light LEDs 316, 318. The output of flip flop 314 changes state when a positive pulse is supplied to input device 302.

The output of flip flop 314 may selectively flow through delay 2 (310). Delay 2 (310) may include components 310, 312. Capacitor 310 may be charged and discharged through resistor 312. When the charge of capacitor 310 reaches the desired voltages, inverter/trigger 2 (327) changes state and powers infrared LEDs 328, 330, 332, and 334.

The output of flip flop 314 may also selectively flow through inverter 3 (324), which then drives the state of inverter 4 (325). The output state of inverter 3 (324) is the same as the output of inverter/trigger 2 (327). The output of inverter 4 (325) is the opposite of the output of inverter 3 (324).

When the IR LEDs 328, 330, 332, 334 are on, the output of inverter 3 (324) is high and the output of inverter 4 (325) is low. The positive pulse from the output of inverter/trigger 1 (326) will only flow through the color LED whose cathode is low, which in this example would be LED 318 (green visible light), indicating that the device is deactivating.

When the IR LEDs 328, 330, 332, 334 are off, the output of inverter 3 (324) is low and the output of inverter 4 (325) is high. The positive pulse from the output of inverter/trigger 1 (326) will only flow through the color LED whose cathode is low, which in this example would be LED 316 (red visible light), indicating that the device is activating.

Figure 4:
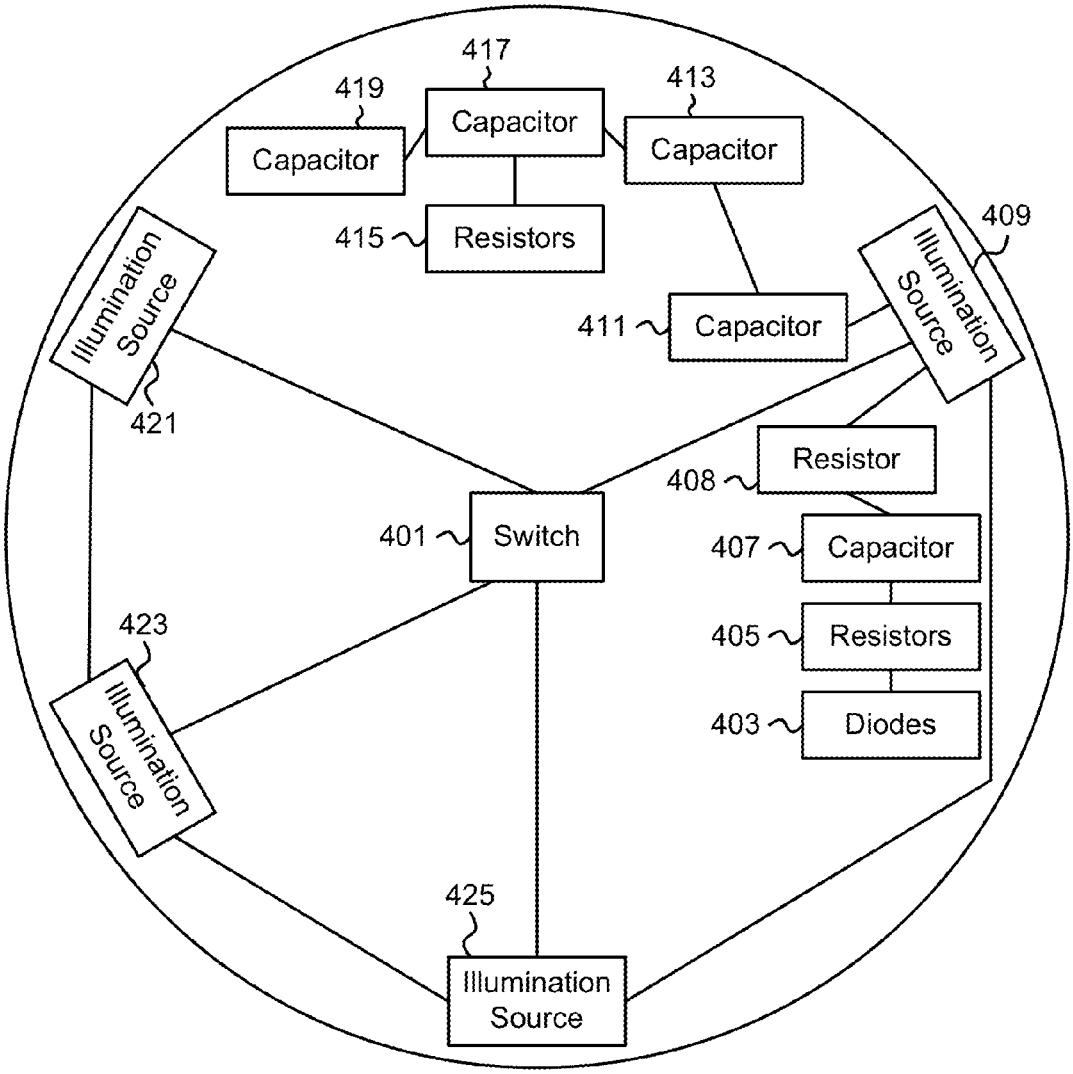
FIG. 4 is a detailed schematic illustration of the handheld illumination device, in accordance with a described implementation.

Referring to FIG. 4, a schematic form of the handheld illumination device is shown. Schematic 400 illustrates the circuitry of the handheld illumination device. The handheld illumination device may include electrical components including switch 401, diodes 403 (which may include LEDs 216 and 218), resistors 405, 415, integrated circuits 407, 413, 419, and illumination sources including illumination sources 409, 421, 423, 425. LEDs may be utilized as illumination sources 409, 421, 423, 425. In another implementation, illumination sources may include other forms of electric lights.

The illumination source(s) may be configured to transmit light over a range of directions spanning at least ninety degrees. In some implementations, the illumination source may be configured to transmit light over a range of directions spanning at least 180 degrees.

In yet another implementation, the illumination source may be configured to transmit light substantially omnidirectionally. For example, the placement of the LEDs may be such that the light radiation is substantially omnidirectional and not in a singular focused beam.

In another implementation, the handheld illumination device may include more or fewer electrical components, connective components, illumination sources, etc. then what is shown.

Figure 5:
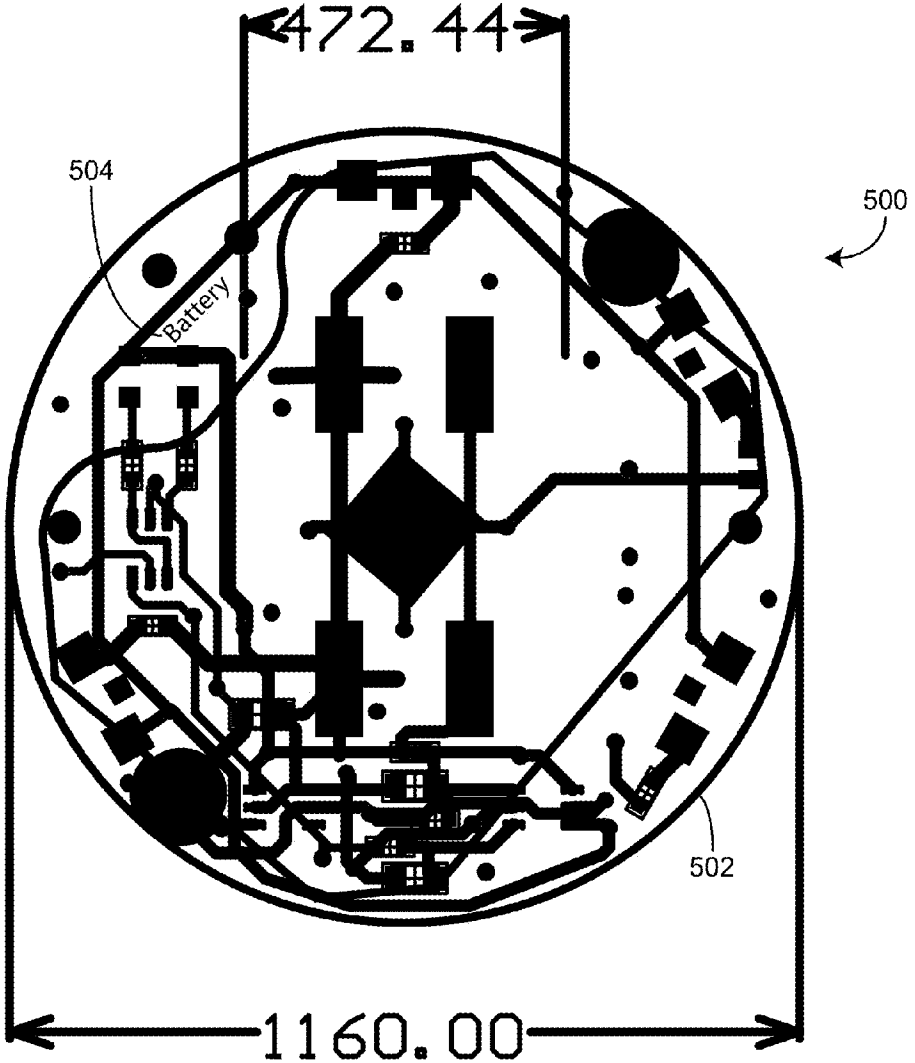
FIG. 5 is an illustration of a printed circuit board of the handheld illumination device, in accordance with a described implementation.

Referring to FIG. 5, a printed circuit board of the handheld illumination device is shown. Printed circuit board 500 is a general view of the handheld illumination device along with housing 502 and battery 504. Housing 502 may be configured to be held in a hand. Housing 502 may include a resilient material disposed near the input device of the handheld illumination device. The resilient material (e.g., an elastomer, PTE, etc.) may be deformable in order to rebound to the housing's original shape, which may be substantially spherical. The spherical nature of housing 502 allows the light to move across any surface. Alternatively, the device may take other shapes, such as a cube, a cone, a cylinder, or other three-dimensional shape having any number of sides, facets, curved surfaces, etc.

The resilient material may allow the device to absorb impact without damaging the interior components. The material also allows the user to activate the input device by squeezing housing 502 in a specified location, without requiring a separate method, mechanical or non-mechanical, of activation or deactivation. The material is also such that it allows for light to pass through the device. The material may or may not enhance light dispersion. For example, the opacity of the material may be at least a 5% opaque, at least 10% opaque, at least 50% opaque, etc. The material may also include different shades of colors, such as black, grey, etc. The material of the illumination device may be shaped in the form of a golf ball, but may also be larger depending on the environment.

Figure 6:
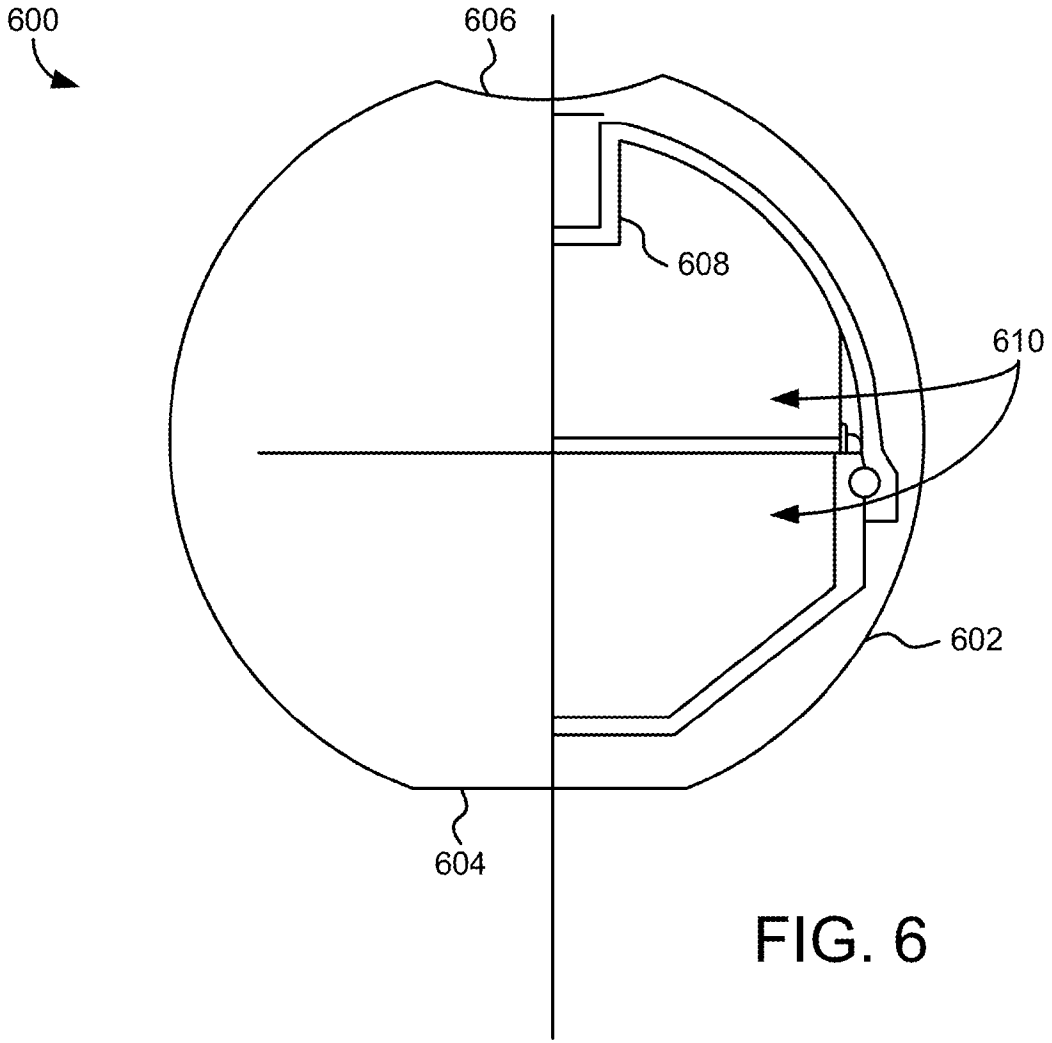
FIG. 6 is an illustration of a housing and an interior of the housing of the handheld illumination device, in accordance with a described implementation.

Referring to FIG. 6, an illustration of the housing and the interior of the housing of the handheld illumination device is shown. Device 600 may include housing 602, faceted side 604 and a second faceted side 606. In some implementations, device 600 may have a diameter of approximately 1.5 inches, but may be smaller or larger. For example, the diameter of the device may be less than three inches, less than 5 inches or less than 10 inches. Device 600 may also include switch activation peg 608 (input device) that minimizes compression by not having to collapse housing 602 in order to activate the handheld illumination device. Device 600 may also include internal cavities 610. Internal cavities 610 may be used for the buoyancy of the device. The cavities may be filled with air, nitrogen or any other appropriate substance.

Figure 7:
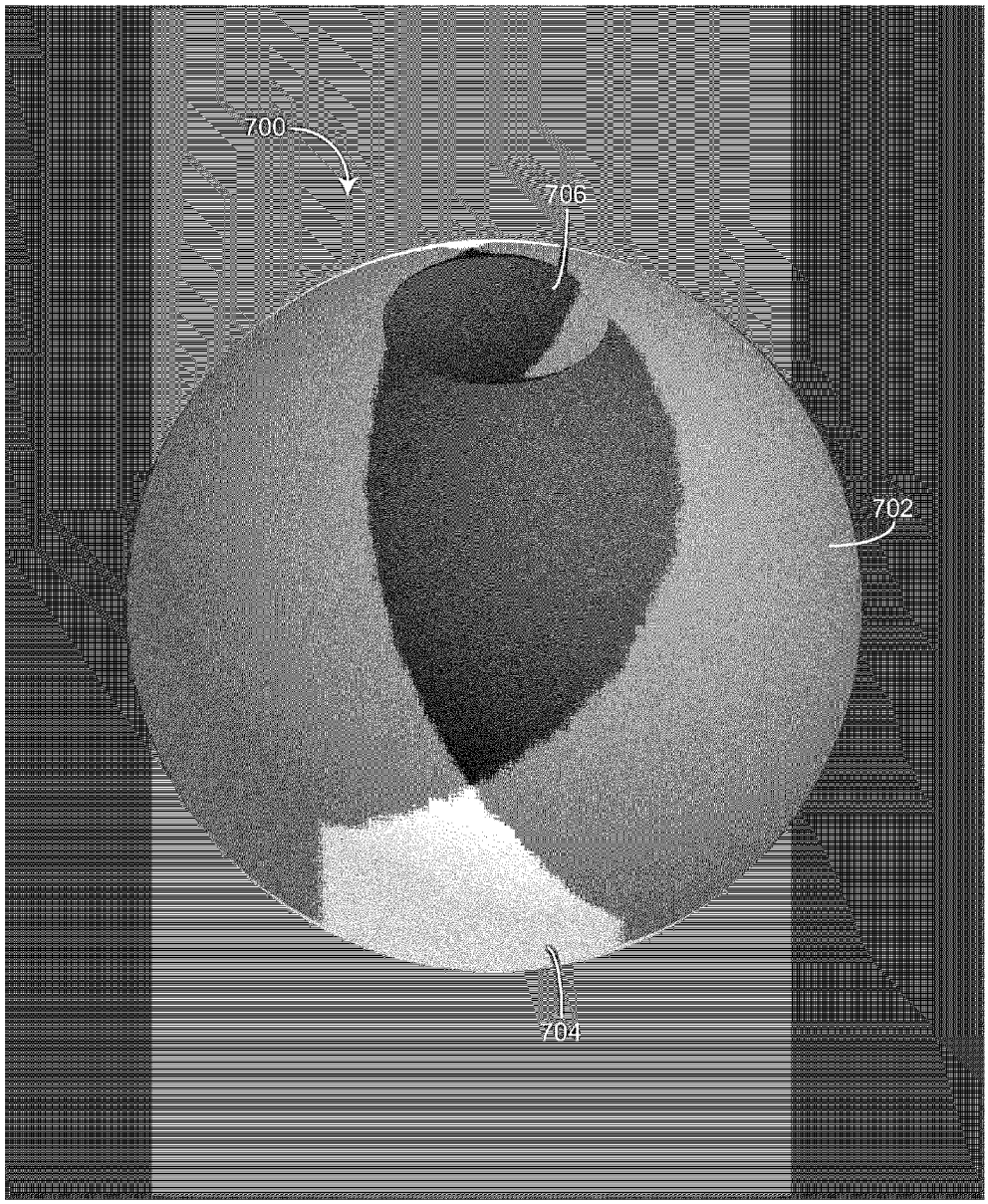
FIG. 7 is an illustration of the exterior of the handheld illumination device, in accordance with a described implementation.

Referring to FIG. 7, an illustration of the exterior of the handheld illumination device is shown. The exterior of the handheld illumination device 700 may include housing 702, faceted side 704 and input device 706.

Housing 702 may be hermetically sealed and configured to provide buoyancy. For example, the material of housing 702 may provide positive buoyancy in liquid environments, making it possible for device 700 to float in certain situations. Housing 702 may be watertight. Internal cavities (not shown) of device 700 may aid in buoyancy as well. Housing 702 may also be configured to at least partially transmit light from the illumination source to an exterior of the device.

The procesing circuit illustrated herein may comprise any digital and/or analog circuit components, such as one or more microprocessors, microcontrollers, application-specific integrated circuits, passive or active electrical components, memory devices, or other circuit elements. The processing circuit may comprise a programmed microprocessor or other circuit programmed to perform the functions described herein. The circuit may comprise a non-transitory, tangible computer-readable storage medium, such as an electronic memory device, programmed with one or more of the functions described herein.

The construction and arrangement of the handheld illumination device as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

What is claimed is:

1. A handheld illumination device, comprising:

a deformable hermetically sealed housing that is configured to be held in a hand and configured to provide buoyancy;

an input device contained within the deformable hermetically sealed housing and configured to be actuated by a user;

a battery;

a first illumination source configured to provide light in an infrared spectrum;

a second illumination source configured to provide light in a visible spectrum;

a processing circuit configured to:

receive actuation of the input device, wherein the actuation of the input device corresponds to the user deforming the housing to engage the input device for a first predetermined amount of time;

upon expiration of the first predetermined amount of time, temporarily illuminate the second illumination source to indicate activation of the input device;

after the user stops deforming the housing of the input device, turn off the second illumination source;

commence a second predetermined amount of time prior to the activation of the first illumination source, wherein elapsing of the second predetermined amount of time cannot be stopped by the user;

upon expiration of the second predetermined amount of time, illuminate the first illumination source.

2. The handheld illumination device of claim 1, wherein the handheld illumination device is substantially spherical.

3. The handheld illumination device of claim 1, wherein the housing further comprises a faceted side adjacent the input device.

4. The handheld illumination device of claim 1, wherein the first predetermined amount of time expires after at least five seconds.

5. The handheld illumination device of claim 1, wherein a center of mass of the handheld illumination device is offset from a physical center of the handheld illumination device, whereby the handheld illumination device is more likely to come to rest on a predetermined portion of the housing.

6. The handheld illumination device of claim 1, wherein the housing is substantially spherical, wherein the housing comprises a faceted side, and wherein the first and the second illumination sources are disposed on a non-faceted side of the housing.

7. The handheld illumination device of claim 1, wherein the housing comprises a resilient material disposed near the input device.

8. The handheld illumination device of claim 1, wherein the housing is configured to at least partially transmit light from the first and the second illumination sources to an exterior of the handheld illumination device.

9. The handheld illumination device of claim 1, wherein the first and the second illumination sources are configured to transmit light over a range of directions spanning at least ninety degrees.

10. The handheld illumination device of claim 1, wherein the first and the second illumination sources are configured to transmit light over a range of directions spanning at least 180 degrees.

11. The handheld illumination device of claim 1, wherein the first and the second illumination sources are configured to transmit light substantially omnidirectionally.

12. The handheld illumination device of claim 1, wherein the processing circuit comprises a circuit board, wherein the input device and battery are coupled to the circuit board.

13. A handheld illumination device, comprising:

a housing configured to be held in a hand;

a battery;

a first illumination source configured to provide light in an infrared spectrum, wherein the first illumination source is configured to transmit light substantially omnidirectionally;

an input device contained within the housing and configured to be actuated by a user, wherein the input device is actuated by the user deforming the housing to begin a first predetermined amount of time; and a second illumination source that temporarily provides light in a visible spectrum after expiration of the first predetermined amount of time, wherein a second predetermined amount of time begins after the user stops deforming the housing of the input device, wherein elapsing of the second predetermined amount of time cannot be stopped by the user and upon expiration of the second predetermined amount of time, the first illumination source is illuminated.

14. A handheld illumination device, comprising:

a hermetically sealed housing that is configured to be held in a hand and configured to provide buoyancy;

a battery;

a first illumination source configured to provide light in an infrared spectrum;

an input device contained within the hermetically sealed housing and configured to be actuated by a user, wherein the input device is actuated by the user deforming the housing to begin a first predetermined amount of time; and a second illumination source that temporarily provides light in a visible spectrum after expiration of the first predetermined amount of time, wherein a second predetermined amount of time begins after the user stops deforming the housing of the input device, and upon expiration of the second predetermined amount of time, the first illumination source is illuminated.

* * * * *